US008562362B2

(12) United States Patent
Jiang et al.

(10) Patent No.: US 8,562,362 B2
(45) Date of Patent: Oct. 22, 2013

(54) SUPPORTED SLIDE SAFETY MEMBER FOR A LOW VOLTAGE POWER CONNECTION DEVICE

(75) Inventors: Jianning Jiang, Zhejiang (CN); Yulin Zhang, Zhejiang (CN); Fang Yu, Zhejiang (CN); Huaiyin Song, Zhejiang (CN); Bing Liu, Zhejiang (CN)

(73) Assignee: Heng Chen, Shanghai (CN)

( * ) Notice: Subject to any disclaimer, the term of this patent is extended or adjusted under 35 U.S.C. 154(b) by 201 days.

(21) Appl. No.: 13/249,664

(22) Filed: Sep. 30, 2011

(65) Prior Publication Data

US 2012/0083143 A1 Apr. 5, 2012

(30) Foreign Application Priority Data

Sep. 30, 2010 (CN) ..... 2010 1 0297882

(51) Int. Cl.
*H01R 13/44* (2006.01)

(52) U.S. Cl.
USPC ..... 439/137; 439/145

(58) Field of Classification Search
USPC ..... 439/137, 145, 135
See application file for complete search history.

(56) References Cited

U.S. PATENT DOCUMENTS

| | | | | |
|---|---|---|---|---|
| 4,722,693 | A * | 2/1988 | Rose | 439/137 |
| 4,867,694 | A * | 9/1989 | Short | 439/137 |
| 6,238,224 | B1 * | 5/2001 | Shao | 439/137 |
| 6,422,880 | B1 * | 7/2002 | Chiu | 439/137 |
| 6,555,771 | B2 * | 4/2003 | Shao | 200/51 R |
| 6,776,630 | B1 * | 8/2004 | Huang | 439/137 |
| 6,814,594 | B1 * | 11/2004 | Huang | 439/137 |
| 7,355,117 | B2 * | 4/2008 | Castaldo et al. | 174/53 |
| 7,887,346 | B1 * | 2/2011 | Huang | 439/140 |
| 7,914,307 | B1 * | 3/2011 | Yang | 439/137 |

* cited by examiner

*Primary Examiner* — Xuong Chung Trans
(74) *Attorney, Agent, or Firm* — The PL Law Group, PLLC

(57) ABSTRACT

A supported slide safety member. A slide block disposed on the inner side of an upper cover of a socket, includes two inclined surfaces in the same direction disposed on the outer side of the slide block with a slide block window respectively disposed on a lower side of each inclined surface, and a protruding supporting shaft disposed on the inner side of the slide block. A cover plate with two cover windows is disposed on the inner side of the slide block, and the outer side of the cover plate is in contact with the supporting shaft. An elastic component is connected between the slide block and the upper cover. A stop surface is disposed on both the inner side and the outer side of a tail end of the slide block, stopped by and upper stop rib and a lower stop rib.

17 Claims, 6 Drawing Sheets

SUPPORTED SLIDE SAFETY MEMBER FOR A LOW VOLTAGE POWER CONNECTION DEVICE

CROSS-REFERENCE TO RELATED APPLICATIONS

This non-provisional application claims priority under 35 U.S.C. §119(a) on Patent Application No. 201010297882.4 filed in China on Sep. 30, 2010, the entire contents of which are hereby incorporated by reference.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a safety member of a low-voltage power connection device, and more particularly to a safety member usable in connection with various types of power sockets and power patch boards, so as to prevent an accidental electric shock.

BACKGROUND OF THE INVENTION

Safety problems are common in a wall socket and a power patch board in the related art. For example, a young child normally has a strong sense of curiosity, if the child holds an object, such as a conductive thin rod, and extends it into a jack of the wall socket or the power patch board thereof, the child naturally may want to touch a conductive metal component therein out of curiosity, which may subject the child to a danger of electric shock. Such kind of safety accidents happens frequently, and raises grave safety concerns of the socket products currently on the market.

Therefore, a heretofore unaddressed need exists in the art to address the aforementioned deficiencies and inadequacies.

SUMMARY OF THE INVENTION

In one aspect, the present invention is directed to a supported slide safety member, so as to solve the problem in the related art that a socket or a patch board is prone to an electric shock.

In one embodiment, the present invention adopts the following technical solution.

A supported slide safety member is disposed on an inner side of an upper cover of a socket or an inner side of an upper cover of a patch board.

At least one pair of jacks is disposed on the upper cover.

A slide block is disposed on an inner side of each pair of jacks. Two inclined surfaces are disposed on the outer side of the slide block corresponding to the two jacks. The two inclined surfaces lean towards the same direction. A slide block window running through the slide block is respectively disposed on a lower side of each inclined surface. A supporting shaft protruding from the side surface is disposed on an inner side of the slide block. The supporting shaft is parallel to the inclined surfaces and is correspondingly disposed between the two inclined surfaces. The slide block has a head end and a tail end. The head end corresponds to one end in the direction of a higher part of the inclined surface, and the tail end corresponds to one end in the direction of a lower part of the inclined surface.

A cover plate is disposed on the inner side of each slide block. An outer side of the cover plate is in contact with the supporting shaft disposed on the inner side of the slide block. Two through cover plate windows are disposed on the cover plate corresponding to the two jacks.

An elastic component is connected between the slide block and the upper cover, and an action direction of an elastic force of the elastic component is in the direction of the head end of the slide block.

A stop surface is disposed on both an inner side and an outer side of the tail end of the slide block. An upper stop rib is disposed on the inner side of the upper cover corresponding to the stop surface on the outer side of the slide block, and a lower stop rib is disposed on the outer side of the cover plate corresponding to the stop surface on the inner side of the slide block.

In a preferred embodiment, the elastic component is a flat spring, one end of the flat spring is fixed in the upper cover, and the other end of the flat spring abuts against the tail end of the slide block.

In a preferred embodiment, angles of inclination of the two inclined surfaces of the slide block are the same.

In a preferred embodiment, a slide block patch is fixed to the inclined surface of the slide block and the slide block patch is made of metal.

In a preferred embodiment, the slide block patch is made of stainless steel.

In a preferred embodiment, the slide block patch is fixed to the inclined surface of the slide block by insertion or injection molding.

In a preferred embodiment, the stop surfaces disposed on the inner side and the outer side of the tail end of the slide block are one surface.

In a preferred embodiment, a cross section of the supporting shaft is in a V shape, a U shape, or a shape of a semi-circle.

Compared with the related art, a supported slide safety member of the present invention adopted with the above technical solution, among other things, has the following advantage. In a situation of non-normal use, no matter which jack of the upper cover the conductive thin rod is extended into, the conductive thin rod is in contact with only one of the inclined surfaces of the slide block, the slide block is rotated around the supporting shaft, and the stop surfaces on the tail end of the slide block abut against the upper stop rib on the upper cover or abut against the lower stop rib on the cover plate. Therefore, the conductive thin rod is incapable of passing through the slide block window on the slide block, and even if the conductive thin rod passes through the slide block window, the conductive thin rod is incapable of continuing to pass through the cover plate window of the cover plate, and certainly incapable of touching power contacts in the socket, thereby ensuring safety.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
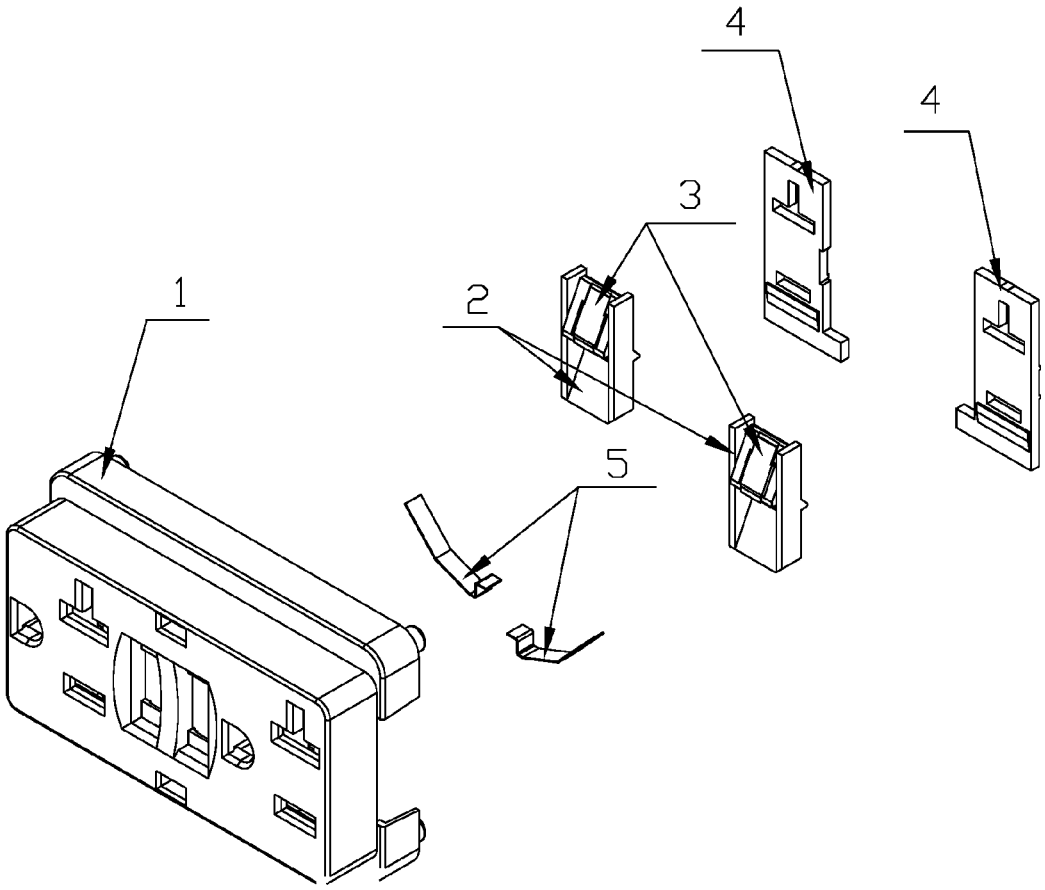
FIG. 1 is a schematic view of an exploded structure of a safety member according to one embodiment of the present invention.
Figure 2:
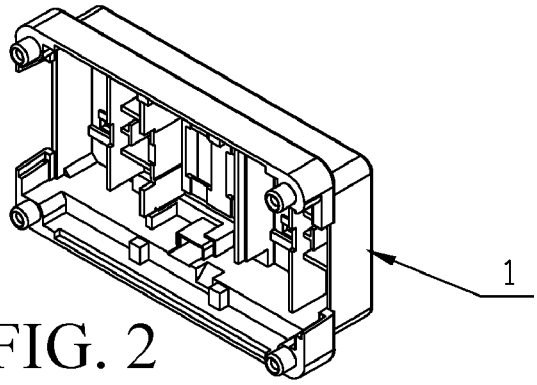
FIG. 2, FIG. 2A, FIG. 2B, and FIG. 2C are respectively a three-dimensional view, a front view, a top view, and a back view of an upper cover.
Figure 2A:
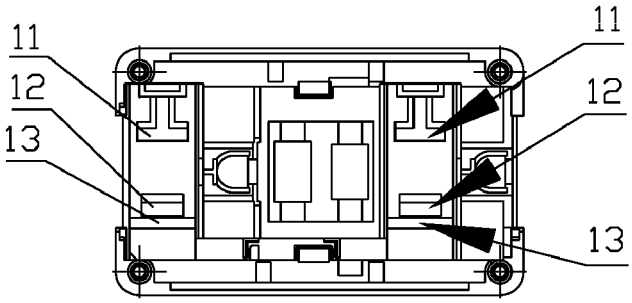
Figure 2B:
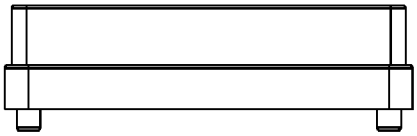
Figure 2C:
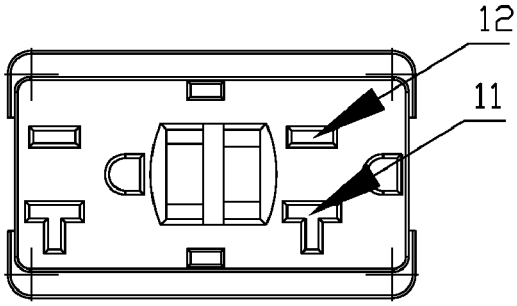
Figure 3:
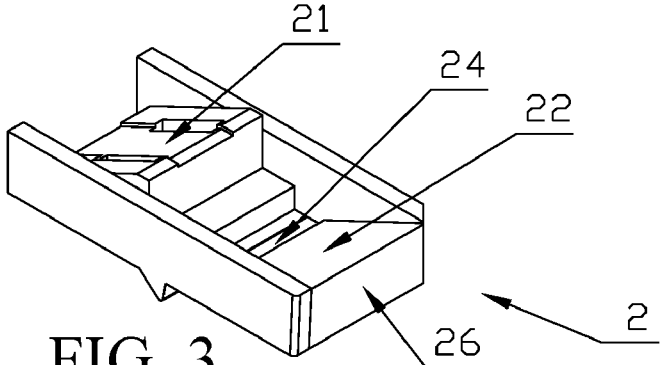
FIG. 3, FIG. 3A, FIG. 3B, and FIG. 3C are respectively a three-dimensional view, a front view, a bottom view, and a back view of a slide block.
Figure 3A:
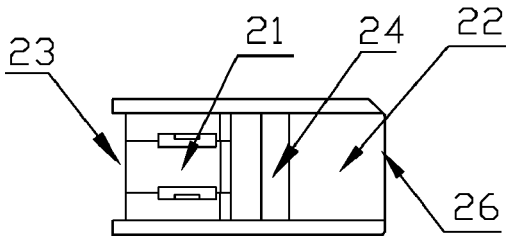
Figure 3B:
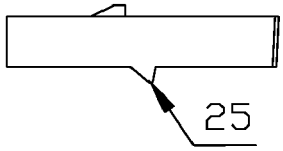
Figure 3C:
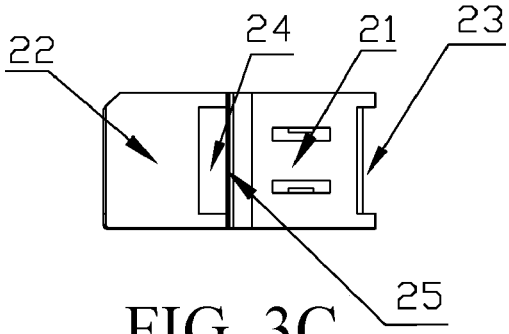
Figure 4:
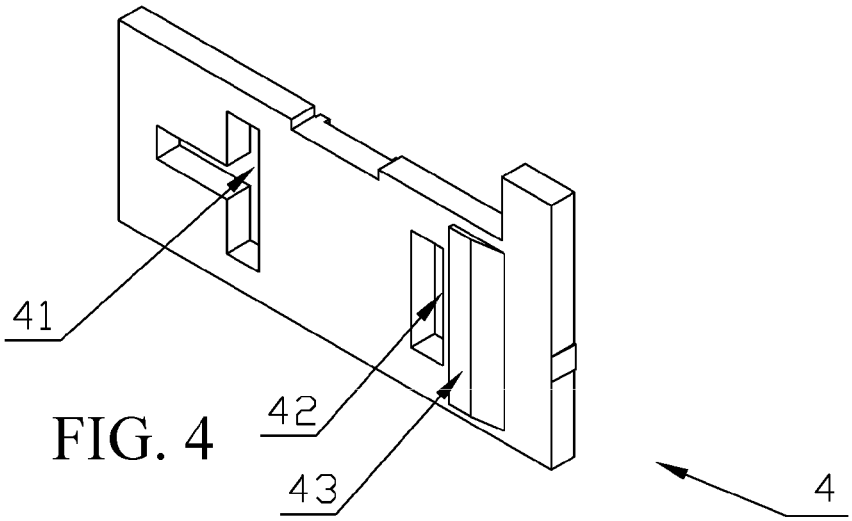
FIG. 4, FIG. 4A, FIG. 4B, and FIG. 4C are respectively a three-dimensional view, a front view, a top view, and a back view of a cover plate.
Figure 4A:
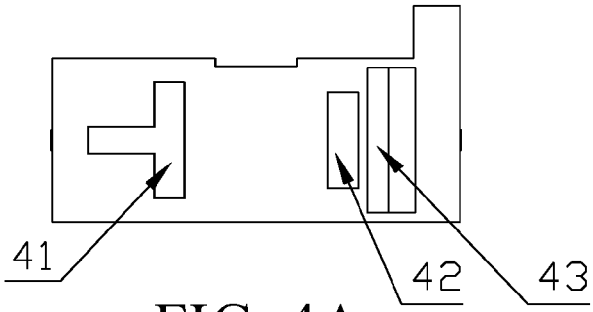
Figure 4B:
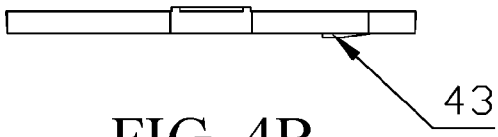
Figure 4C:
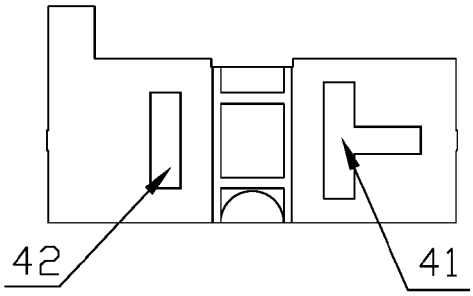

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Referring now to FIG. 1, the present invention is disposed in, for example, a GFCI safety socket, so as to illustrate the structure and function of the present invention. A slide block 2, a slide block patch 3, a cover plate 4, and a flat spring 5 are disposed on the inner side of an upper cover 1 of the safety socket.

The upper cover 1, as shown in FIG. 2, FIG. 2A, FIG. 2B, and FIG. 2C, is provided with at least one pair of jacks 11, 12 for a positive plug and a negative plug to plug therein at the same time.

One slide block 2 is disposed on the inner side of each pair of jacks 11, 12. The structure of the slide block 2 is as shown in FIG. 3, FIG. 3A, FIG. 3B, and FIG. 3C. Two inclined surfaces 21, 22 are disposed on the outer side of the slide block 2 corresponding to the two jacks 11, 12. The two inclined surfaces 21, 22 lean towards the same direction (better if the angles of inclination are also the same). A slide block window 23, 24 running through the slide block 2 is further disposed on the lower side of each inclined surface 21, 22. A V-shaped supporting shaft 25 protruding from the side surface is disposed on the inner side of the slide block 2. The V-shaped supporting shaft 25 is parallel to the above inclined surfaces 21, 22 and is correspondingly disposed between the two inclined surfaces 21, 22. For the convenience of the description, the slide block 2 is hereinafter regarded to have a head end and a tail end. The head end corresponds to one end in the direction of the higher part of the inclined surface 21, 22, and the tail end corresponds to one end in the direction of the lower part of the inclined surface 21, 22.

The slide block patch 3, as a non-essential component, is made of metal (such as stainless steel), and can be fixed to the inclined surface 21, 22 of the slide block 2 by insertion or injection molding, so as to enhance abrasion resistance of the slide block 2, thereby increasing mechanical life of the product.

One cover plate 4 is disposed on the inner side of each slide block 2. The outer side of the cover plate 4 is a smooth surface and is in contact with the V-shaped supporting shaft 25 disposed on the inner side of the slide block 2. Two through cover plate windows 41, 42 are disposed on the cover plate 4 corresponding to the two jacks 11, 12.

One end of the flat spring 5 is fixed in the upper cover 1, and the other end of the flat spring 5 abuts against the tail end of the slide block 2. The action direction of the elastic force of the flat spring 5 is in the direction of the head end of the slide block 2.

Furthermore, referring to FIG. 2A, FIG. 4B, FIG. 6, and FIG. 7, a stop surface 26 is disposed on both the inner side and the outer side of the tail end of the slide block 2 (in this embodiment, the two stop surfaces 26 are actually one surface). An upper stop rib 13 is disposed on the inner side of the upper cover 1 corresponding to the stop surface 26 on the outer side of the slide block 2, and a lower stop rib 43 is disposed on the outer side of the cover plate 4 corresponding to the stop surface 26 on the inner side of the slide block 2.

The safety member of the present invention can be used at least in two situations.

Figure 5:
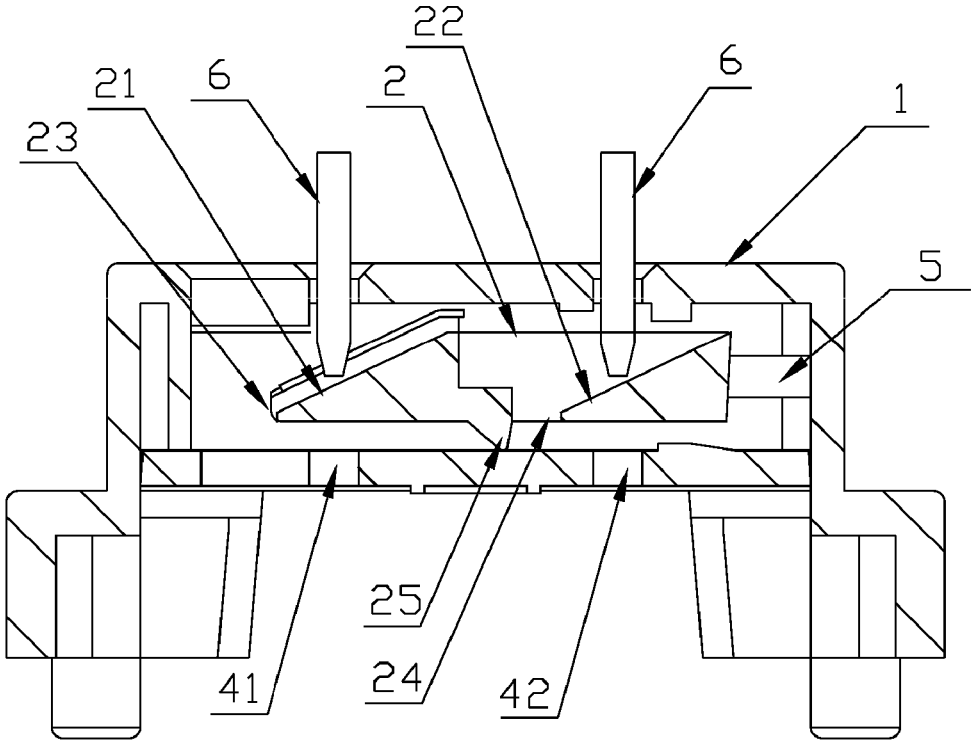
FIG. 5 is a schematic view of the slide block in a parallel movement.

Referring to FIG. 5, in a situation of normal use, positive and negative plugs 6 are plugged into the jacks 11, 12 of the upper cover 1 and contact the two inclined surfaces 21, 22 of the slide block 2 at the same time. The V-shaped supporting shaft 25 of the slide block 2 contacts the outer side surface of the cover plate 4. At the time, torques formed at the V-shaped supporting shaft 25 due to pressures acting on the inclined surfaces 21, 22 by the two plugs 6 are almost the same. Therefore, the slide block 2 is not prone to any large deflection and is likely to move horizontally towards the tail end of the slide block 2 under the action of the horizontal component on the two inclined surfaces 21, 22. Finally, the positive and negative plugs 6 run through the slide block windows 23, 24 on the slide block 2, and then run through the cover plate windows 41, 42 on the cover plate 4, thereby touching power contacts in the socket.

Figure 6:
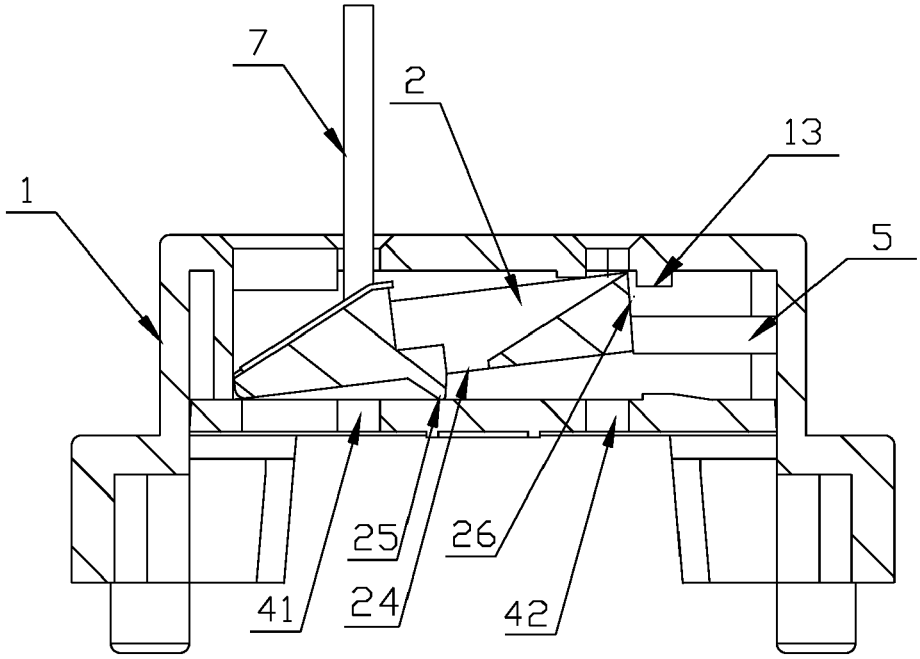
FIG. 6 is a schematic view of the slide block in a first seesaw-like movement.
Figure 7:
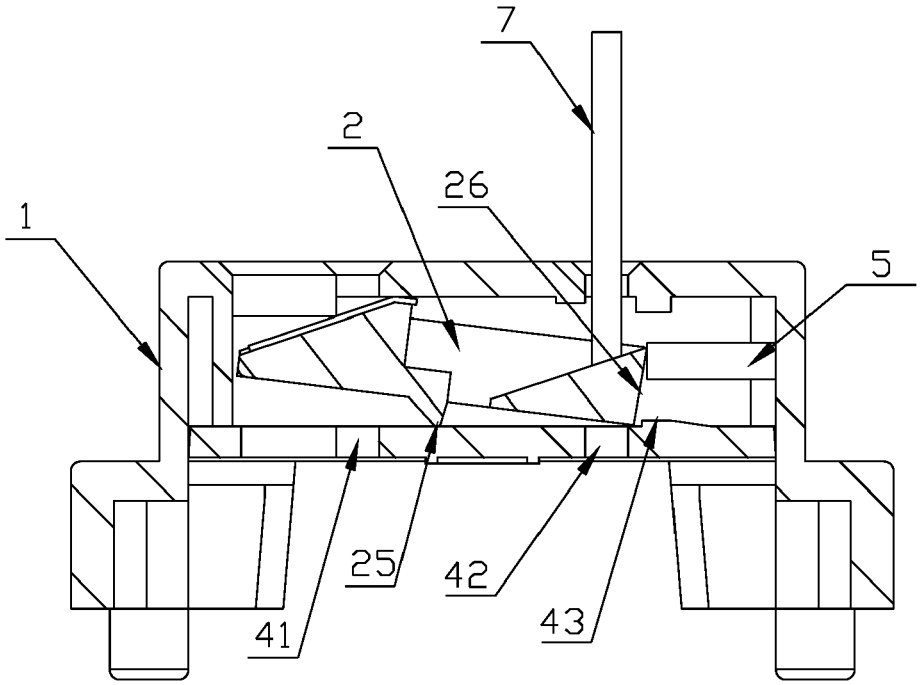
FIG. 7 is a schematic view of the slide block in a second seesaw-like movement.

Referring to FIG. 6 and FIG. 7, in a situation of non-normal use, no matter which jack 11, 12 of the upper cover 1 a conductive thin rod 7 is extended into, the conductive thin rod 7 is in contact with only one of the inclined surfaces 21, 22 of the slide block 2, the slide block 2 is rotated around the V-shaped supporting shaft 25, and the stop surfaces 26 on the tail end of the slide block 2 abut against the upper stop rib 13 on the upper cover 1 (as shown in FIG. 6) or abut against the lower stop rib 43 on the cover plate 4 (as shown in FIG. 7). Therefore, the conductive thin rod 7 is incapable of passing through the slide block window 23, 24 of the slide block 2, and even if the conductive thin rod 7 passes through the slide block window 23, 24, the conductive thin rod 7 is incapable of continuing to pass through the cover plate window 41, 42 of the cover plate 4, and certainly incapable of touching the power contacts in the socket, thereby ensuring safety.

In one embodiment, apart from the flat spring 5, a wire spring (a spiral spring or a scroll spring) may also be used as an elastic component. The slide block 2 and the upper cover 1 are connected through the elastic component, and the action direction of the elastic force of the elastic component is in the direction of the head end of the slide block 2. There are various implementations, and details are not repeated here. Furthermore, for the supporting shaft protruding from the inner side of the slide block 2, the cross sectional shape thereof may also be, besides the V shape, a U shape or the shape of a semi-circle.

Accordingly, in one aspect, the present invention provides a supported slide safety member disposable on an inner side of an upper cover of a socket or an inner side of an upper cover of a patch board, wherein at least one pair of jacks is disposed on the upper cover. In one embodiment, the supported slide safety member has a slide block disposed on an inner side of each pair of jacks, wherein two inclined surfaces are formed on an outer side of the slide block corresponding to the two jacks, the two inclined surfaces lean towards the same direction, and a slide block window running through the slide block is respectively disposed on a lower side of each inclined surface, wherein a supporting shaft protruding from the side surface is disposed on an inner side of the slide block, the supporting shaft is parallel to the inclined surfaces and is correspondingly disposed between the two inclined surfaces, and wherein the slide block has a head end and a tail end.

The supported slide safety member also has a cover plate disposed on the inner side of each slide block, wherein an outer side of the cover plate is in contact with the supporting shaft disposed on the inner side of the slide block, and two through cover plate windows are disposed on the cover plate corresponding to the two jacks.

The supported slide safety member further has an elastic component connected between the slide block and the upper cover, and a stop surface disposed on both an inner side and an outer side of the tail end of the slide block.

In one embodiment, the elastic component is a flat spring, one end of the flat spring is fixed in the upper cover, and the other end of the flat spring abuts against the tail end of the slide block.

In one embodiment, the elastic component is positioned such that an action direction of an elastic force of the elastic component is in the direction of the head end of the slide block.

In one embodiment, the head end of the slide block corresponds to one end in the direction of a higher part of the inclined surface, and the tail end of the slide block corresponds to one end in the direction of a lower part of the inclined surface.

In one embodiment, as formed, angles of inclination of the two inclined surfaces of the slide block are the same.

In one embodiment, a slide block patch is fixed to the inclined surface of the slide block.

In one embodiment, the slide block patch is made of metal such as stainless steel.

In one embodiment, the slide block patch is fixed to the inclined surface of the slide block by insertion or injection molding.

In one embodiment, the stop surfaces disposed on the inner side and the outer side of the tail end of the slide block are one surface.

In one embodiment, a cross section of the supporting shaft is in a V shape, a U shape, or a shape of a semi-circle.

In one embodiment, an upper stop rib is disposed on the inner side of the upper cover corresponding to the stop surface on the outer side of the slide block, and a lower stop rib is disposed on the outer side of the cover plate corresponding to the stop surface on the inner side of the slide block.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A supported slide safety member, disposable on an inner side of an upper cover of a socket or an inner side of an upper cover of a patch board, wherein at least one pair of jacks is disposed on the upper cover, comprising:

a slide block disposed on an inner side of each pair of jacks, wherein two inclined surfaces are disposed on an outer side of the slide block corresponding to the two jacks, the two inclined surfaces lean towards the same direction, and a slide block window running through the slide block is respectively disposed on a lower side of each inclined surface, wherein a supporting shaft protruding from the side surface is disposed on an inner side of the slide block, the supporting shaft is parallel to the inclined surfaces and is correspondingly disposed between the two inclined surfaces, and wherein the slide block has a head end and a tail end, the head end corresponds to one end in the direction of a higher part of the inclined surface, and the tail end corresponds to one end in the direction of a lower part of the inclined surface;

a cover plate disposed on the inner side of each slide block, wherein an outer side of the cover plate is in contact with the supporting shaft disposed on the inner side of the slide block, and two through cover plate windows are disposed on the cover plate corresponding to the two jacks;

an elastic component connected between the slide block and the upper cover, wherein an action direction of an elastic force of the elastic component is in the direction of the head end of the slide block; and a stop surface disposed on both an inner side and an outer side of the tail end of the slide block, wherein an upper stop rib is disposed on the inner side of the upper cover corresponding to the stop surface on the outer side of the slide block, and a lower stop rib is disposed on the outer side of the cover plate corresponding to the stop surface on the inner side of the slide block, wherein the elastic component is a flat spring, one end of the flat spring is fixed in the upper cover, and the other end of the flat spring abuts against the tail end of the slide block.

2. The supported slide safety member according to claim 1, wherein the elastic component is a flat spring, one end of the flat spring is fixed in the upper cover, and the other end of the flat spring abuts against the tail end of the slide block.

3. The supported slide safety member according to claim 1, wherein angles of inclination of the two inclined surfaces of the slide block are the same.

4. The supported slide safety member according to claim 1, wherein a slide block patch is fixed to the inclined surface of the slide block and the slide block patch is made of metal.

5. The supported slide safety member according to claim 4, wherein the slide block patch is made of stainless steel.

6. The supported slide safety member according to claim 4, wherein the slide block patch is fixed to the inclined surface of the slide block by insertion or injection molding.

7. The supported slide safety member according to claim 1, wherein the stop surfaces disposed on the inner side and the outer side of the tail end of the slide block are one surface.

8. The supported slide safety member according to claim 1, wherein a cross section of the supporting shaft is in a V shape, a U shape, or a shape of a semi-circle.

9. A supported slide safety member, disposable on an inner side of an upper cover of a socket or an inner side of an upper cover of a patch board, wherein at least one pair of jacks is disposed on the upper cover, comprising:

a slide block disposed on an inner side of each pair of jacks, wherein two inclined surfaces are formed on an outer side of the slide block corresponding to the two jacks, the two inclined surfaces lean towards the same direction, and a slide block window running through the slide block is respectively disposed on a lower side of each inclined surface, wherein a supporting shaft protruding from the side surface is disposed on an inner side of the slide block, the supporting shaft is parallel to the inclined surfaces and is correspondingly disposed between the two inclined surfaces, and wherein the slide block has a head end and a tail end;

a cover plate disposed on the inner side of each slide block, wherein an outer side of the cover plate is in contact with the supporting shaft disposed on the inner side of the slide block, and two through cover plate windows are disposed on the cover plate corresponding to the two jacks;

an elastic component connected between the slide block and the upper cover; and a stop surface disposed on both an inner side and an outer side of the tail end of the slide block, wherein the elastic component is a flat spring, one end of the flat spring is fixed in the upper cover, and the other end of the flat spring abuts against the tail end of the slide block, and is positioned such that an action direction of an elastic force of the elastic component is in the direction of the head end of the slide block.

10. The supported slide safety member according to claim 9, wherein the head end of the slide block corresponds to one end in the direction of a higher part of the inclined surface, and the tail end of the slide block corresponds to one end in the direction of a lower part of the inclined surface.

11. The supported slide safety member according to claim 9, wherein angles of inclination of the two inclined surfaces of the slide block are the same.

12. The supported slide safety member according to claim 9, wherein a slide block patch is fixed to the inclined surface of the slide block.

13. The supported slide safety member according to claim 12, wherein the slide block patch is made of metal.

14. The supported slide safety member according to claim 12, wherein the slide block patch is fixed to the inclined surface of the slide block by insertion or injection molding.

15. The supported slide safety member according to claim 9, wherein the stop surfaces disposed on the inner side and the outer side of the tail end of the slide block are one surface.

16. The supported slide safety member according to claim 9, wherein a cross section of the supporting shaft is in a V shape, a U shape, or a shape of a semi-circle.

17. The supported slide safety member according to claim 9, wherein an upper stop rib is disposed on the inner side of the upper cover corresponding to the stop surface on the outer side of the slide block, and a lower stop rib is disposed on the outer side of the cover plate corresponding to the stop surface on the inner side of the slide block.

* * * * *